United States Patent [19]

Raudat

[11] Patent Number: 5,020,306

[45] Date of Patent: Jun. 4, 1991

[54] CONTINUOUS MOTION PACKER FOR FEEDING CONTAINERS INTO END-TO-END PACKING CASES

[75] Inventor: John L. Raudat, North Madison, Conn.

[73] Assignee: Standard-Knapp, Inc., Portland, Conn.

[21] Appl. No.: 480,746

[22] Filed: Feb. 15, 1990

[51] Int. Cl.[5] ..... B65B 35/44

[52] U.S. Cl. ..... 53/534; 53/246; 53/251

[58] Field of Search ..... 53/48, 49, 244, 245, 53/246, 247, 248, 251, 443, 448, 475, 534, 539, 543; 198/419.3

[56] References Cited

U.S. PATENT DOCUMENTS 3,599,397 8/1971 Standley et al. ..... 53/534 X
4,389,832 6/1983 Calvert ..... 53/534 X
4,531,345 7/1985 Nigrelli et al. ..... 53/534
4,704,841 11/1987 Langenbeck ..... 53/448
4,901,501 2/1990 Raudat et al. ..... 53/534 X

*Primary Examiner*—Robert L. Spruill
*Assistant Examiner*—Daniel B. Moon
*Attorney, Agent, or Firm*—McCormick, Paulding & Huber

[57] ABSTRACT

Two side-by-side columns of containers are fed between laterally spaced container conveyors that have lugs which move inwardly between the adjacent containers of each column. Some lugs are oversized to create a space between the foremost containers in one slug or array and the last containers in an adjacent array. These lugs also have bifurcated lower portions and the lug conveyors move these lugs downwardly to engage the adjacent end panels of two end-to-end packing cases so the containers can be lowered into these cases at a load station.

12 Claims, 4 Drawing Sheets

CONTINUOUS MOTION PACKER FOR FEEDING CONTAINERS INTO END-TO-END PACKING CASES

BACKGROUND OF THE INVENTION

This invention relates generally to apparatus for packing cylindrical containers into upwardly open packing cases as the packing cases move in end-to-end relationship in a downstream direction. The packing case may be of the tab-lock type, and may include pockets defined by inserts provided inside the packing case. The purpose of the present invention is to pack relatively large cylindrical containers, such as plastic soda bottles or the like, in the cases as the container and the packing cases move continuously in a downstream direction.

Prior art packers of this type generally require that the line of containers be periodically stopped so that the containers can be grouped in an array or slug in accordance with the present day "drop packer" technology.

In other present case packers the containers and the cases do move continuously. Nigrelli U.S. Pat. No. 4,531,345 is typical of such case loaders. In this prior art Nigrelli packer provision is made for separating the containers into arrays or slugs for loading, but the packing cases are themselves separated and cannot be loaded in end-to-end relationship as taught herein.

SUMMARY OF THE INVENTION

In accordance with the present invention an apparatus or method is disclosed for loading cylindrical containers into upwardly open packing cases that may include pockets for receiving the containers. These cases are moved continuously in end-to-end relationship in a downstream direction. The packing cases may be of the "tab-lock" type wherein the top flaps are folded back adjacent the corresponding upright panels of the packing case, and wherein these top flaps are joined to one another at the corners of the packing case by an integrally formed tab.

The containers are moved in two discrete columns by individual lane conveyors so that the containers are rearranged from an initial nested configuration and provided in side-by-side relationship to one another. Spaces are provided between the adjacent containers in each of these columns while maintaining these containers in such side-by-side relationship. Deadplate means is provided downstream of these individual lane conveyors and side conveyors are provided with inwardly projecting lugs that the lugs move inwardly between the containers to create the desired spacing between certain of the containers and these side conveyor lugs also move the containers across the container deadplate means.

Some of these lugs are uniformly spaced to provide a uniform spacing between the containers and other lugs have a different shape and define a greater spacing between certain of the containers. Thus, the containers in the first row of each slug and the containers in the next adjacent slug are spaced from one another a greater distance than are adjacent containers within a particular slug or array.

Container engaging gravity rails at the downstream end of the container deadplate means serve to lower the containers into the packing cases at a load station. The aforementioned other of different shape lugs are bifurcated with depending leg portions for engaging the adjacent packing cases, and more particularly for engaging the end panels of the adjacent end-to-end packing cases. These other lugs thereby serve to maintain the packing cases in a predetermined relationship to one another to assure that the containers provided between the first mentioned lugs are fed into an associated packing case.

Case conveying means is provided below the path of the containers for moving the cases downstream in end-to-end relationship, and case deadplate means below said container deadplate means to provide the end-to-end cases at the load station.

DETAILED DESCRIPTION

Figure 1:
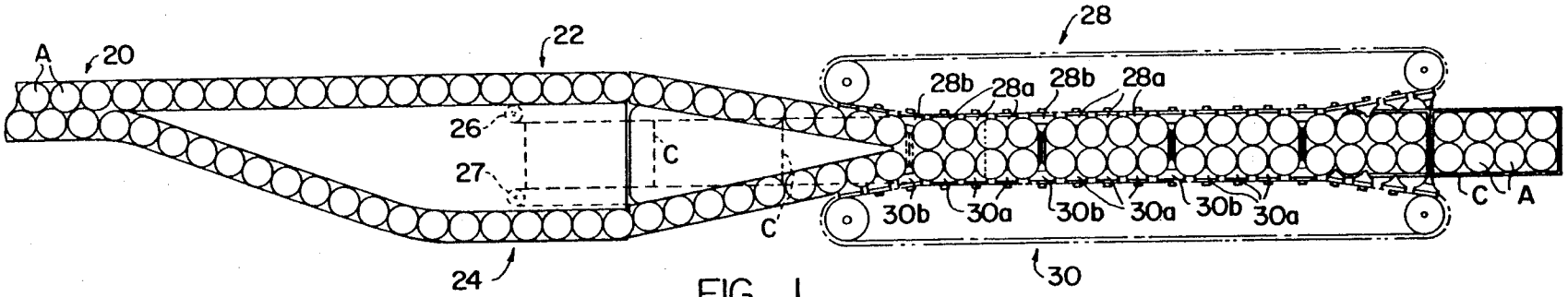
FIG. 1 is an overall top plan view of an apparatus incorporating a continuous motion packer constructed in accordance with the present invention.

Turning now to the drawings in greater detail, FIG. 1 shows the overall configuration for an apparatus constructed in accordance with the present invention. Two side-by-side container columns are formed from an initial nested configuration, as indicated generally at 20, to a configuration between container engaging lug conveyors 28 and 30 wherein the containers are provided in side-by-side relationship and in longitudinally indexed relation to the packing cases C, C. The containers A, A are formed into slugs or arrays that are accurately indexed relative to the packing cases, C, C.

The container engaging lug conveyors are fed individual columns of containers by two legs, one of which 24 is longer than the other 22 so that the containers arrive at the infeed end of the container engaging lug conveyors in end-to-end relationship but in side-by-side relationship as well. Thus, the lugs **28*a* and 30*a* on each of the lug conveyors 28 and 30** are arranged one opposite another.

The upwardly open paperboard cartons or packing cases C, C are advanced downward in end-to-end relationship by side belt conveyors 26 and 27 as best shown in FIG. 1. These conveyors 26 and 27 create a line pressure on the cases downstream thereof, which downstream cases continue to move on a suitable deadplate or other comparable support table structure. Thus, the container rows move into the infeed end of the container lug conveyors 28 and 30 in timed relationship with movement of the packing cases therebelow. Certain of these lugs, **28*b* and 30*b***, are provided vertically above the end panels of the packing cases and more particularly above the adjacent end panels of two adjacent packing cases.

Figure 8:
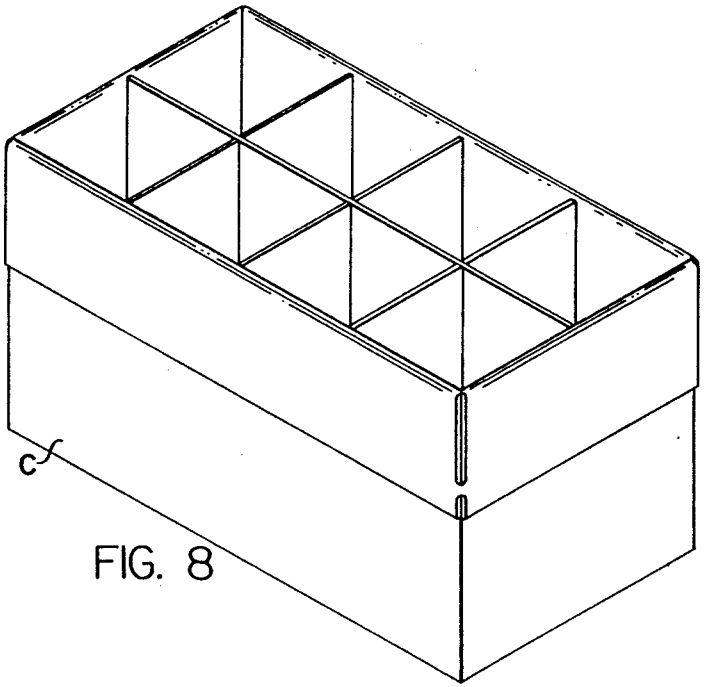
FIG. 8 is a perspective view of a tab-lock case with partitions.
Figure 2:
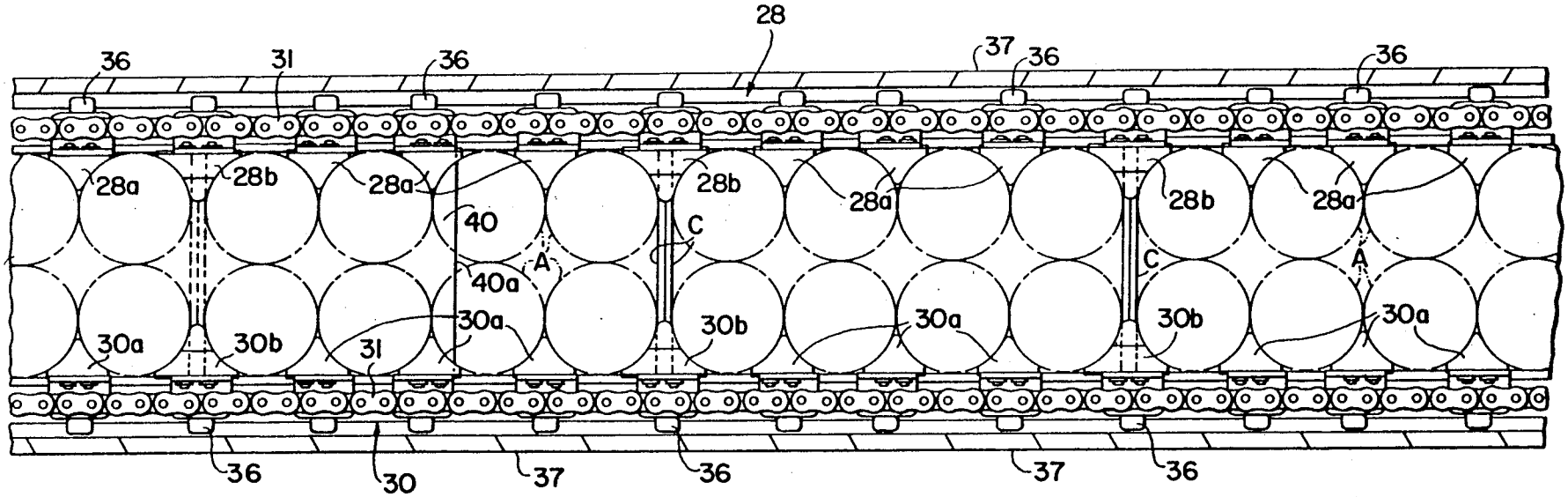
FIG. 2 is a top plan view of the packer section of the apparatus of FIG. 1.

Each packing case may have partitions provided therein so as to define pockets for receiving the generally cylindrical containers. Furthermore, these packing cases are preferably of the "tab-lock" type wherein the top flaps are integrally joined to one another at adjacent corners of the case as best shown in FIG. 8.

The individual lane conveyors 22 and 24 which feed the containers to the upstream or inlet end of the container lug conveyors 28 and 30 terminate at that point and a container deadplate is provided for supporting the containers as they are indexed relative to form each slug between the lugs 28*b* and 30*b* as suggested in FIG. 1. The requisite spacing between the endmost containers in one slug and the endmost containers within an adjacent end-to-end slug is provided by the lug conveyors 28 and 30. This spacing is accomplished by reason of the lugs 28*b* and 30*b* on the lug conveyors moving inwardly between the containers of the adjacent slugs.

The containers within each slug may be spaced slightly to permit packing cases with pockets, but as shown the lugs 28*a* and 30*a* merely serve to index the containers to maintain them in close relationship to one another. The somewhat larger lugs 28*b* and 30*b* separate the containers at the trailing and leading edge or end of each slug of containers to accommodate the end panels and associated top flaps of the end-to-end packing cases. The packing cases are preferably driven by side belts that engage the side panels, or the down folded top flaps, and hence serve to maintain the packing cases in the condition shown for them in FIG. 1.

Figure 3:
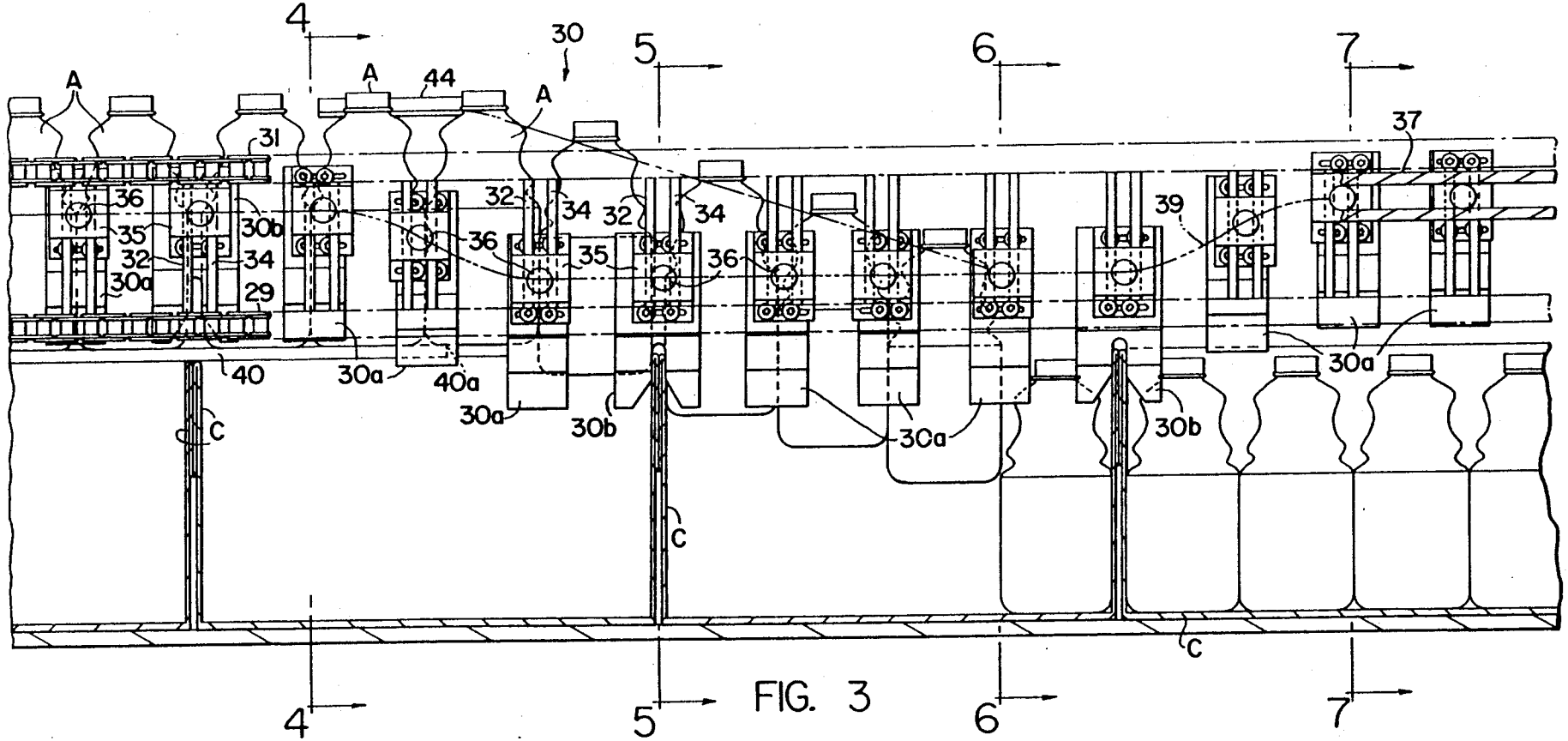
FIG. 3 is a side elevational view of the packer section illustrated in FIG. 2.
Figure 4:
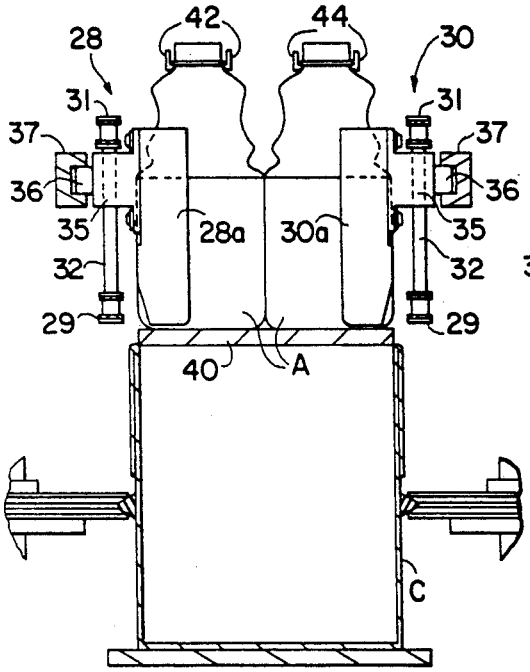
FIG. 4 is a vertical sectional view taken on the line 4—4 of FIG. 3.
Figure 5:
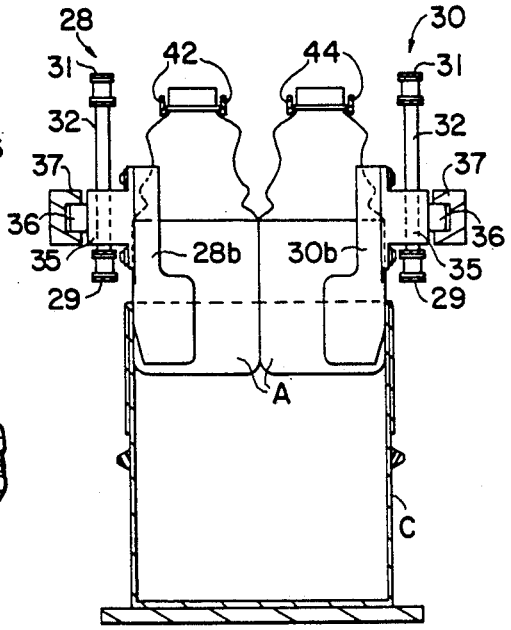
FIG. 5 is a vertical sectional view taken generally on the line 5—5 of FIG. 3.
Figure 6:
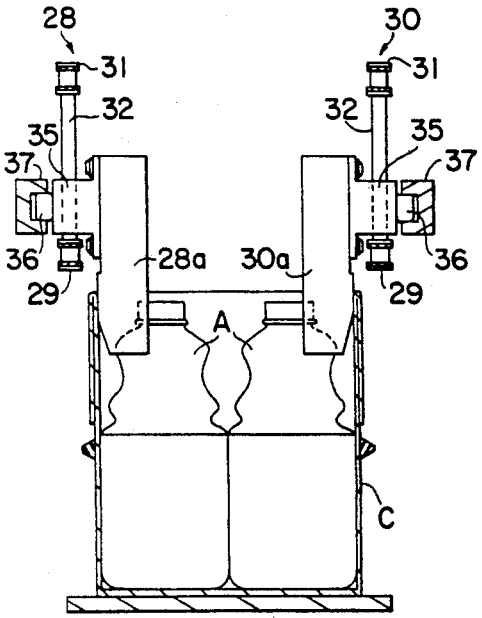
FIG. 6 is a vertical sectional view taken generally on the line 5—5 of FIG. 3.
Figure 7:
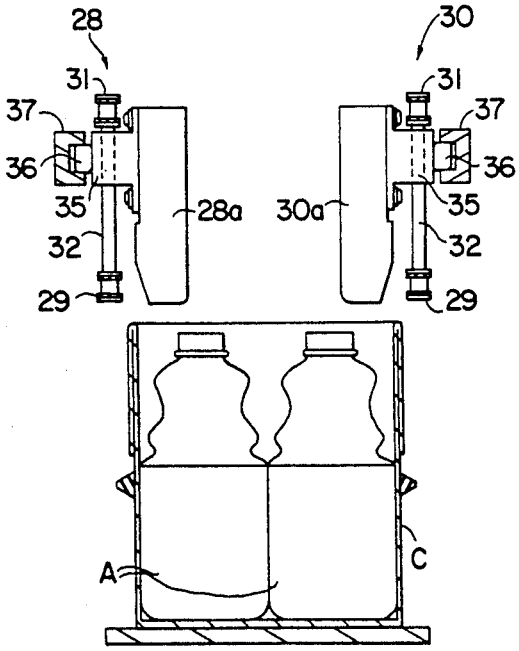
FIG. 7 is a vertical sectional view taken generally on the line 7—7 of FIG. 3.

Turning now to a more detailed description of FIG. 3 and the container engaging lug conveyors 28 and 30, each such conveyor includes a pair of vertically spaced chains, 29 and 31, which chains are joined together by spindles 32 and 34, which spindles are arranged in pairs at predetermined longitudinal locations on these chains. Each pair of spindles has as associated slide block 35 provided thereon, and each such slide block 35 supports a lug 28*a* and 28*b* for movement in between adjacent containers as described previously. Each slide block 35 also includes a cam roller 36 provided on a pin projecting oppositely from the lug 28*a* and 28*b* and this cam roller is received in a fixed cam track 37 provided between the moving chains 29 and 31. The rollers 36 cause a predetermined vertical movement of the slide blocks 35 and the lugs as the lugs move in a generally horizontal direction as suggested by the line 39 in FIG. 3.

This vertical movement of the lugs is especially important to achieve a proper mating of the containers with the continuously moving end-to-end packing cases. While some of these lugs namely first lugs 28*a* and 30*a* merely engage the containers themselves, other lugs, namely second lugs 28*b* and 30*b* are of bifurcated configuration at their lower ends and adapted to receive the upper edges of the end panels of the adjacent packing cases. Thus, movement of the container lug conveyors and more particularly of the chains is timed to movement of the packing cases in order that these other lugs 28*b* and 30*b* mate with the adjacent end panels of the adjacent packing cases.

At the load station, defined at the downstream end 40*a* of the container deadplate means 40, the containers are fed by gravity rails 42 and 44 which rails support the containers from their necks even as the containers are controlled by the lugs 28*a* and 30*a* in order to deposit the containers in the upwardly open packing case provided therebelow. As referred to previously the lugs and more specifically the lugs 28*b* and 30*b* will engage the adjacent end panels of the packing cases to assure that the packing cases are properly aligned with the containers. Thus, the containers and packing cases move continuously in the downstream direction and there is no need to interrupt the flow of either the packing cases or the containers, or to provide for corresponding spacing of these containers and packing cases in the apparatus of the present invention.

It should be noted that in some situations it may be possible to provide only for vertical movement of the lugs 28*b* and 30*b* associated with the end panels of the packing case. In such situations those non-vertically movable lugs may simply be clamped to the spindles and serve only to separate the containers from one another and to control their movement along the deadplate with the result that these lugs need not move vertically nor need they engage the packing case (or packing case dividers if they be provided within the packing case). The important feature of the present invention is to provide for vertical movement of at least the oversized lugs 28*b* and 30*b* provided at the line of demarcation between the adjacent slugs of containers, and to provide for these oversized lugs to engage the adjacent end panels of the packing cases as referred to previously.

In order to provide for handling containers of various size or diameter the lugs 28*a*, 28*b* and 30*a*, 30*b* are removably secured to their respective slide blocks 35, 35. This construction permits these lugs to be removed and replaced by lugs of a different geometry. The lugs are removably secured to the slide blocks by screws that pass through slots in the side blocks and are threadably received in the lugs themselves. This construction will permit varying the pitch of the lugs to accommodate containers of different size.

I claim:

1. Apparatus for loading containers into packing cases as the packing cases move in end-to-end relationship in a downstream direction, said apparatus comprising infeed conveyor means for orienting the containers into two columns so that the containers in these columns are provided in side-by-side relationship, container deadplate means, packing case conveying means for moving the packing cases downstream below the path of movement of the container columns, to feed the end-to-end cases in turn through a load station, container engaging lug conveyors alongside said container columns, said lug conveyors having longitudinally spaced first and second lugs that move between the containers to create a predetermined spacing therebetween as the containers move toward said load station, said first lugs being uniformly spaced with respect to one another in order to space the containers uniformly within each slug to be loaded into each packing case, said second lugs so dimensioned as to create a slightly greater space between adjacent containers, container engaging gravity rails at the downstream end of said container deadplate means to lower the containers into a packing case at the load station, said container engaging lug conveyors being synchronized with movement of said packing cases so that said first lugs engage the containers, said second lugs including lower end portions for engaging the adjacent end panels of the packing cases, and means for achieving controlled vertical movement of at least said second lugs at the load station so that the lower end portions thereof engage the adjacent end panels of said end-to-end packing cases at said load station.

2. The apparatus according to claim 1 wherein said means for achieving controlled vertical movement of at least said second lug at the load station comprises vertically oriented spindles, and wherein said lug conveyors comprise vertically spaced chains supporting said spindles.

3. The apparatus according to claim 2 wherein said second lugs have bifurcated lower portions for engaging the adjacent end panels of end-to-end packing cases, and wherein each such second lug further includes a slide block slidably received on said spindles.

4. The apparatus according to claim 3 wherein said second lugs are adjustably secured to their respective slide blocks to permit setting up the apparatus for handling containers of various size.

5. The apparatus according to claim 4 wherein said first lugs are adjustably secured to slide blocks, and wherein such slide blocks are vertically movable on spindles as with said second lugs, whereby all of said lugs may be repositioned to vary the pitch therebetween in order to accommodate containers of different size.

6. The apparatus according to claim 5 wherein said slide blocks are adjustably secured to said lugs by screw fasteners, said slide blocks having horizontally extending slots and said lugs having threaded openings for threadably receiving said screw fasteners.

7. The apparatus according to claim 1 wherein both said first and second lugs associated with said container engaging lug conveyors are moved vertically at said load station.

8. The apparatus according to claim 7 wherein said means for achieving controlled vertical movement of at least said second lug at the load station comprises vertically oriented spindles, and wherein said lug conveyors comprise vertically spaced chains supporting said spindles.

9. The apparatus according to claim 8 wherein said second lugs have bifurcated lower portions for engaging the adjacent end panels of end-to-end packing cases, and wherein each such second lug further includes a slide block slidably received on said spindles.

10. The apparatus according to claim 9 wherein said second lugs are adjustably secured to their respective slide blocks to permit setting up the apparatus for handling containers of various size.

11. The apparatus according to claim 10 wherein said first lugs are adjustably secured to slide blocks, and wherein such slide blocks are vertically movable on spindles as with said second lugs, whereby all of said lugs may be repositioned to vary the pitch therebetween in order to accommodate containers of different size.

12. The apparatus according to claim 11 wherein said slide blocks are adjustably secured to said lugs by screw fasteners, said slide blocks having horizontally extending slots and said lugs having threaded openings for threadably receiving said screw fasteners.

* * * * *